US007846032B2

(12) United States Patent
Zamperla et al.

(10) Patent No.: US 7,846,032 B2
(45) Date of Patent: Dec. 7, 2010

(54) AMUSEMENT RIDE

(75) Inventors: Alberto Zamperla, Vicenza (IT); Antonio Nardin, Vicenza (IT)

(73) Assignee: Antonio Zamperla S.p.A., Vicenza ( * ) Notice: Subject to any disclaimer, the term of this patent is extended or adjusted under 35 U.S.C. 154(b) by 286 days.

(21) Appl. No.: 11/319,248

(22) Filed: Dec. 27, 2005

(65) Prior Publication Data

US 2006/0154735 A1 Jul. 13, 2006

Related U.S. Application Data

(63) Continuation of application No. 11/115,880, filed on Apr. 26, 2005, now abandoned.

(60) Provisional application No. 60/566,057, filed on Apr. 27, 2004.

(51) Int. Cl.
*A63G 1/30* (2006.01)
*A63G 1/00* (2006.01)

(52) U.S. Cl. ..... 472/34; 472/39

(58) Field of Classification Search ..... 472/29, 472/32, 33, 34, 118, 119, 39, 6, 7
See application file for complete search history.

(56) References Cited

U.S. PATENT DOCUMENTS

| | | | |
|---|---|---|---|
| 314,881 | A | 3/1885 | Sassack |
| 730,521 | A | 6/1903 | Doner |
| 832,800 | A | 10/1906 | Mercer |
| 979,385 | A | 12/1910 | Doran |
| 1,023,897 | A | 4/1912 | Walsh |
| 1,044,391 | A | 11/1912 | Jones |
| 1,087,722 | A | 2/1914 | Brundage |
| 1,179,232 | A | 4/1916 | Shewan |
| 1,206,651 | A | 11/1916 | Barido |
| 1,333,407 | A | 3/1920 | Gibson |
| 1,409,279 | A | 3/1922 | Boldizzoni |
| 1,461,075 | A | 7/1923 | Tuso |
| 1,477,498 | A | 12/1923 | Jackson et al. |
| 1,502,484 | A | 7/1924 | Olson |
| 1,548,747 | A | 8/1925 | Reeves |
| 1,588,941 | A | 6/1926 | Chapman |
| 1,608,442 | A | 11/1926 | Tardete |
| 1,614,051 | A | 1/1927 | Tottereau |
| 1,713,703 | A | 5/1929 | Lester |
| 1,734,856 | A | 11/1929 | Irsch |

(Continued)

FOREIGN PATENT DOCUMENTS

EP 0408835 A1 * 1/1991

(Continued)

OTHER PUBLICATIONS

International Search Report, Appln. No. PCT/EP05/04460, filed Apr. 26, 2005.

(Continued)

*Primary Examiner*—Kien T Nguyen
(74) *Attorney, Agent, or Firm*—Kenyon & Kenyon LLP

(57) ABSTRACT

An amusement ride includes a central unit that rotates about a central axis and a plurality of carriages positioned circumferentially around and pivotably coupled to the central unit. The amusement ride further includes an arrangement for inducing the plurality of carriages to oscillate in a substantially vertical direction as the carriages revolve around the central axis.

15 Claims, 3 Drawing Sheets

U.S. PATENT DOCUMENTS

| | | | | | |
|---|---|---|---|---|---|
| 1,899,060 | A | | 2/1933 | Schmidt | |
| 1,941,024 | A | | 12/1933 | Stanzel | |
| 1,996,923 | A | | 4/1935 | Jacobsen | |
| 2,113,131 | A | | 4/1938 | Eyerly | |
| 2,195,805 | A | | 4/1940 | Baker | |
| 2,202,543 | A | | 5/1940 | Walker et al. | |
| 2,211,876 | A | | 8/1940 | Barnard | |
| 2,239,506 | A | | 4/1941 | Neal | |
| 2,239,542 | A | | 4/1941 | Stanzel | |
| 2,255,013 | A | | 9/1941 | Maynes | |
| 2,280,643 | A | | 4/1942 | Courtney | |
| 2,282,763 | A | | 5/1942 | Kennedy | |
| 2,294,166 | A | | 8/1942 | Eyerly | |
| 2,307,737 | A | | 1/1943 | Courtney | |
| 2,312,533 | A | | 3/1943 | Eyerly | |
| 2,362,190 | A | | 11/1944 | Cortes | |
| 2,412,060 | A | | 12/1946 | Psaila | |
| 2,428,607 | A | | 10/1947 | Bartlett | |
| 2,468,893 | A | * | 5/1949 | Orance | 472/39 |
| 2,547,152 | A | | 4/1951 | Burg | |
| 2,572,859 | A | | 10/1951 | Hall | |
| 2,659,601 | A | | 11/1953 | Siverts | |
| 2,704,666 | A | | 3/1955 | Tyler | |
| 2,726,085 | A | | 12/1955 | Brand | |
| 2,806,697 | A | | 9/1957 | Huhn et al. | |
| 2,869,871 | A | | 1/1959 | Mithcell | |
| 2,895,735 | A | | 7/1959 | Bartlett | |
| 2,922,648 | A | | 1/1960 | Bradley, Jr. | |
| 2,983,509 | A | * | 5/1961 | Haug | 472/39 |
| 2,995,369 | A | | 8/1961 | Amble | |
| 3,034,785 | A | | 5/1962 | Graham | |
| 3,104,103 | A | * | 9/1963 | Haug | 472/39 |
| 3,112,927 | A | | 12/1963 | Eyerly et al. | |
| 3,136,075 | A | | 6/1964 | Brian | |
| 3,153,536 | A | | 10/1964 | Bartlett | |
| 3,243,184 | A | | 3/1966 | Robinson et al. | |
| 3,408,068 | A | * | 10/1968 | Winton | 472/37 |
| 3,459,422 | A | | 8/1969 | Winton | |
| 3,498,604 | A | * | 3/1970 | Schwarzkopf | 472/39 |
| 3,598,403 | A | * | 8/1971 | Bartlett | 472/39 |
| 3,603,583 | A | * | 9/1971 | Bartlett | 472/39 |
| 3,633,904 | A | | 1/1972 | Kojima | |
| 3,666,264 | A | | 5/1972 | Bartlett | |
| 3,707,282 | A | | 12/1972 | Robinson | |
| 3,767,194 | A | | 10/1973 | Barber | |
| 3,905,596 | A | | 9/1975 | Barber | |
| 3,993,304 | A | | 11/1976 | Ahrens | |
| 3,999,751 | A | | 12/1976 | Scardino | |
| 4,842,267 | A | | 6/1989 | Kastner | |
| 5,303,603 | A | | 4/1994 | Boots | |
| 5,395,290 | A | | 3/1995 | Knijpstra | |
| 5,527,221 | A | | 6/1996 | Brown et al. | |
| 5,533,935 | A | * | 7/1996 | Kast | 472/130 |
| 5,558,581 | A | | 9/1996 | Knijpstra | |
| 5,658,200 | A | | 8/1997 | Ellis | |
| 5,688,178 | A | * | 11/1997 | Emrie | 472/31 |
| 5,791,998 | A | | 8/1998 | Moser et al. | |
| 5,810,641 | A | | 9/1998 | Lo | |
| 5,810,671 | A | * | 9/1998 | Balwanz et al. | 472/118 |
| 5,957,779 | A | | 9/1999 | Larson | |
| 6,328,658 | B1 | | 12/2001 | Gnezdilov | |
| 6,620,051 | B2 | | 9/2003 | Kroon et al. | |

FOREIGN PATENT DOCUMENTS

| | | |
|---|---|---|
| FR | 626 890 | 9/1927 |

OTHER PUBLICATIONS www.amtechintl.com/spinout.htm.
www.amtechintl.com/orbiter.htm.
www.amtechintl.com/scorpion.htm.
www.ride-extravaganza.com/rides/explorer/.
www.hussrides.com/46FamilyFlyWilly.htm.
www.wisdomrides.com.

* cited by examiner

AMUSEMENT RIDE

CROSS-REFERENCE TO RELATED APPLICATIONS

The present application is a continuation of U.S. patent application Ser. No. 11/115,880, filed on Apr. 26, 2005 now abandoned, which claims the benefit of U.S. Provisional Patent Application No. 60/566,057, filed on Apr. 27, 2004, and claims the benefit of U.S. Provisional Patent Application No. 60/566,057, filed on Apr. 27, 2004, each of which is expressly incorporated herein in its entirety by reference thereto.

FIELD OF THE INVENTION

The present invention relates generally to an amusement ride, and relates more particularly to a ride having carriages that revolve around a central unit in which the carriages bounce up and down as they revolve.

BACKGROUND INFORMATION

The growth of the amusement industry has led to the development of a wide variety of rides designed for children and adults. Among the wide variety of rides, one of the historically more prevalent types is the carousel, in which carriages that may seat one or more passengers revolve around a central axial unit. Originally, the passenger carriages were designed to resemble horses or coaches, but over time, carousels have been updated to include carriages designed to imitate modern vehicles, such as automobiles. Among the more common of the automobile designs is the 'dune buggy', popular with children.

One of the main limitations of the typical carousel ride is the monotonous quality of its passenger motion. The passenger simply revolves around the central unit, usually at a constant speed, with rather stilted lateral and vertical motion. This lack of versatility has, over time, made the typical carousel ride a less attractive ride in comparison to other ride types introduced to amusement parks.

SUMMARY

According to an example embodiment of the present invention, an amusement ride includes: a central unit configured to rotate about a central axis; a plurality of carriages positioned circumferentially around the central unit and pivotably coupled to the central unit by a respective cantilever arm, the carriages rotatable about the central axis in accordance with rotation of the central unit; and an arrangement configured to induce each carriage to periodically oscillate in a substantially vertical direction during rotation of the carriages about the central axis.

The amusement ride may include an arrangement configured to damp the periodic oscillation of the carriages.

The amusement ride may include a plurality of cantilever arms, via which the carriages are pivotably coupled to the central unit. The amusement ride may further include: a plurality of lower arms pivotably coupled to the central unit, each lower arm arranged below a corresponding shaft; and a bellows arranged between each corresponding pair of cantilever arms and lower arms.

The amusement ride may include a plurality of bumpers, each bumper positioned adjacent to and beneath a corresponding one of the bellows.

The bumpers may be configured to stop a downward pivoting of a corresponding cantilever arm.

Each of the bellows may be configured to expand and/or compress when the respective cantilever and lower arm to which it is coupled pivot relatively with respect to one another.

The arrangement configured to induce the carriages to oscillate in a substantially vertical direction may include a ramp, the ramp including an abruptly ending upwardly sloping portion The arrangement configured to induce the carriages to oscillate in a vertical direction includes a ramp, the ramp including an upwardly sloping portion that ends in a substantially vertical portion.

The carriages may be arranged in the shape of a motor vehicle, e.g., a dune buggy.

According to an example embodiment of the present invention, an amusement ride includes: a central unit for rotating about a central axis; a plurality of carriages positioned circumferentially around the central unit and pivotably coupled to the central unit by respective pivoting means, the carriages rotatable about the central axis in accordance with rotation of the central unit; and means for inducing each carriage to periodically oscillate in a substantially vertical direction during rotation of the carriages about the central axis.

According to an example embodiment of the present invention, a method for operating an amusement ride having a plurality of carriages includes: rotating the carriages on a central unit about a central axis; moving the carriages upwardly during the rotating step at at least one first predetermined circumferential position; after the moving step and during the rotating step, abruptly dropping the carriages at a second predetermined circumferential position after the upwardly moving step; and after the dropping step and during the moving step, resiliently oscillatingly bouncing the carriages.

The method may include damping the oscillatory motion of the carriages.

The carriages may be pivotably coupled to the central unit by cantilever arms, and the cantilever arms may be arranged to interact with bellows to damp a pivoting motion of the cantilever arms.

The cantilever arms may be coupled to rollers that periodically engage an upwardly sloping ramp during the rotating step.

The method may include elastically stopping a downward movement of the carriages at a lower limit point.

DETAILED DESCRIPTION

Figure 1:
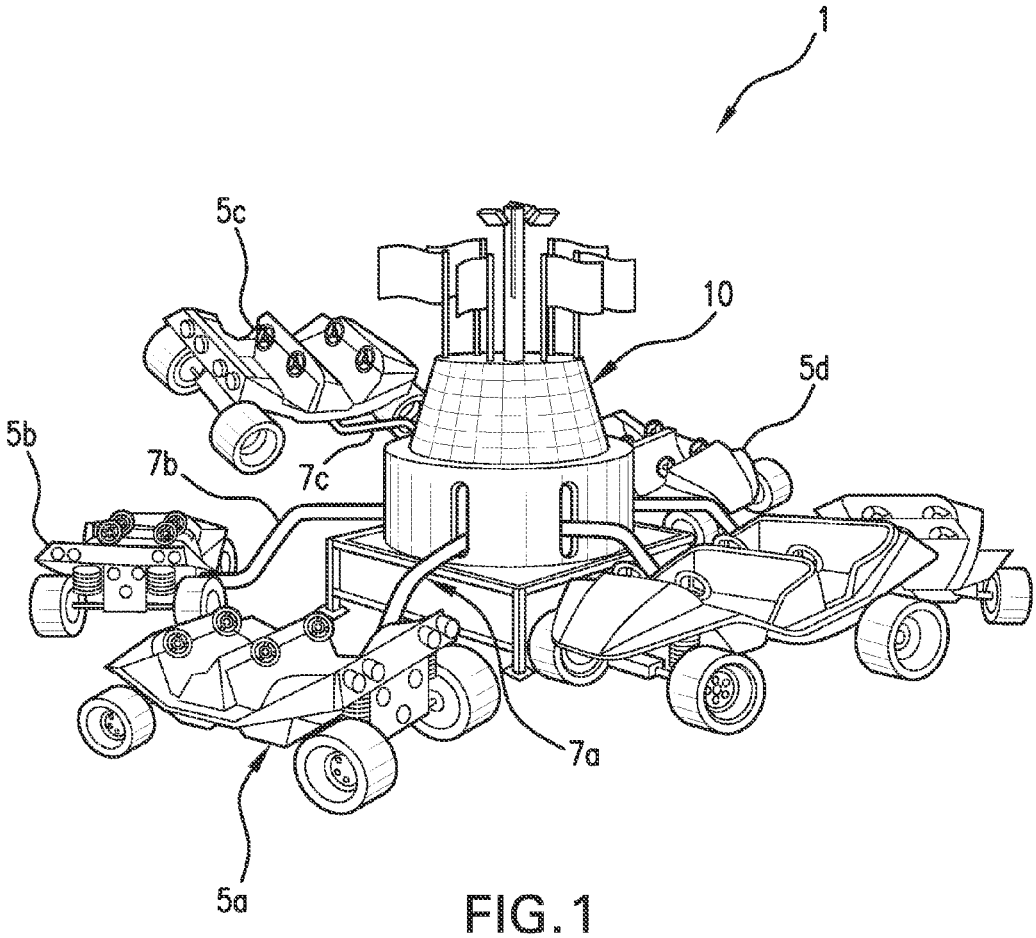
FIG. 1 is a schematic perspective view of an example embodiment of an amusement ride according to the present invention.

Those skilled in the art will gain an appreciation of the present invention from a reading of the following description when viewed in conjunction with the accompanying drawings of FIGS. 1 to 4, inclusive. The individual reference characters designate the same or similar elements throughout the several views.

Referring now to FIG. 1, there is shown a schematic perspective view of an example embodiment of an amusement ride 1 according to the present invention. As shown, a plurality of carriages, e.g., 5*a*, 5*b* and 5*c*, are coupled to a central unit 10 by respective shafts or cantilever arms 7*a*, 7*b* and 7*c* that radiate outwardly from and are pivotably attached to the central unit 10. The carriages 5*a*, 5*b*, 5*c* are suspended above the ground by the shafts 7*a*, 7*b*, 7*c*. The carriages may be implemented in the shape of, e.g., miniature cars or buggies. The size of the buggies may be dimensioned so as to enable seating of two adults or children of a desired age range in both a front seating area and a back seating area. As indicated in an example embodiment of the amusement ride 1 shown in top plan view in FIG. 3, the ride 1 may include six carriages 5*a*, 5*b*, 5*c*, 5*d*; 5*e*, 5*f*, in total, that are each pivotably coupled to the central unit 10 by respective shafts 7*a*, 7*b*, 7*c*, 7*d*, 7*e*, 7*f*. The carriages 5*a*, 5*b*, 5*c*, 5*d*, 5*e*, 5*f* are uniformly spaced circumferentially, forming a hexagonal pattern about the central unit 10. It should be understood and appreciated that any number of carriages and shafts may be provided and that the carriages may take any desired form, including, e.g., a motor vehicle, boat, canoe, raft, bus, train, bicycle, motorcycle, tricycle, horse or other animal, sled, toboggan, skateboard, roller skate, plane, hang glider, roller coaster, spaceship, rocket, etc.

The central unit 10 includes a motor and rotates about its central axis. As the central unit 10 rotates and the carriages 5*a*, 5*b*, 5*c* travel in circumferential paths substantially in a horizontal plane about the central axis, each carriage periodically encounters one or more structures or arrangements, described in greater detail below, that cause the carriages to pivot in an upward direction. When a carriage includes passengers, the weight of the passengers counteracts the upward momentum and movement of the carriage so that the upward motion reaches an upper limit and then the carriage begins to pivot downward. This downward movement is in turn limited by an additional bumper structure off of which the carriage may bounce or 'jump' in a semi-elastic manner. Due to its momentum, as the carriage bounces it may retrace its upward path. This motion is repeated cyclically so that the carriage oscillates between an upper limit position and the stopper structure. This oscillatory movement may be damped to control the speed and smoothness of the oscillation. During this oscillation the passenger(s) experiences an undulating vertical jumping motion in addition to the horizontal revolving motion.

Figure 2:
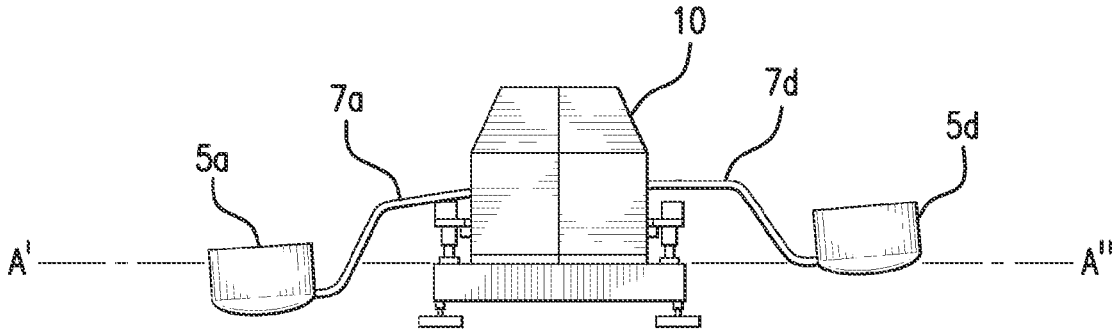
FIG. 2 is a schematic elevational view of an example embodiment of an amusement ride.
Figure 3:
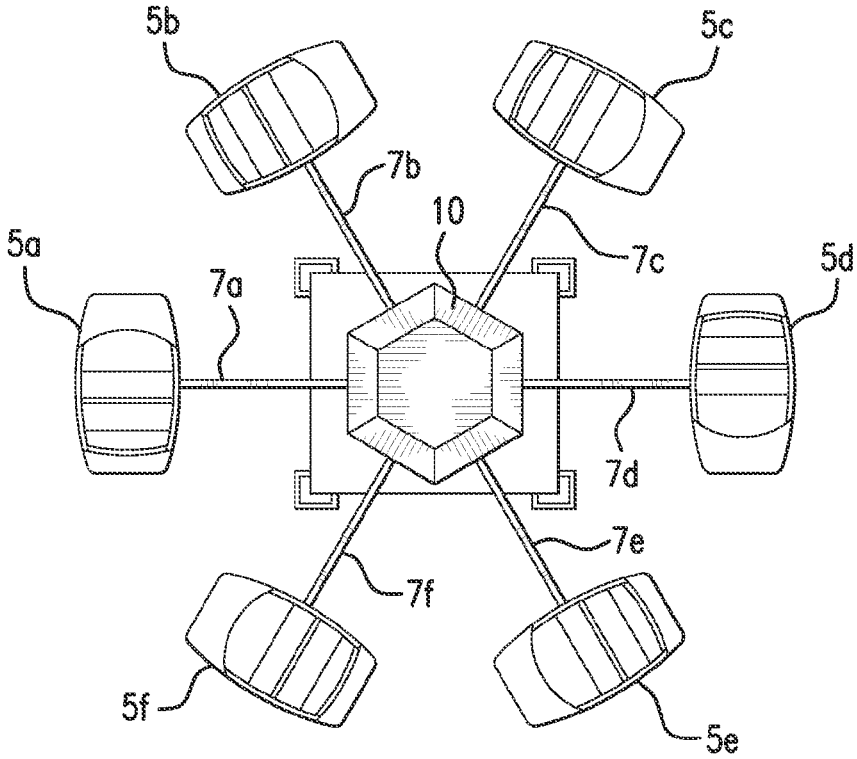
FIG. 3 is a schematic top plan view of the amusement ride illustrated in FIG. 2.

This vertical motion is schematically illustrated in FIG. 2. In FIG. 2, one of the carriages 5*a* is illustrated as positioned substantially below horizontal plane A' A", while another carriage 5*d* is illustrated as positioned substantially above the plane A' A". Thus, while the carriages fixedly revolve around the central axis at the same speed, each carriage pivots up or down independently, and at any given time, each carriage may therefore be at a different phase of oscillation with respect to the other carriages.

Figure 4:
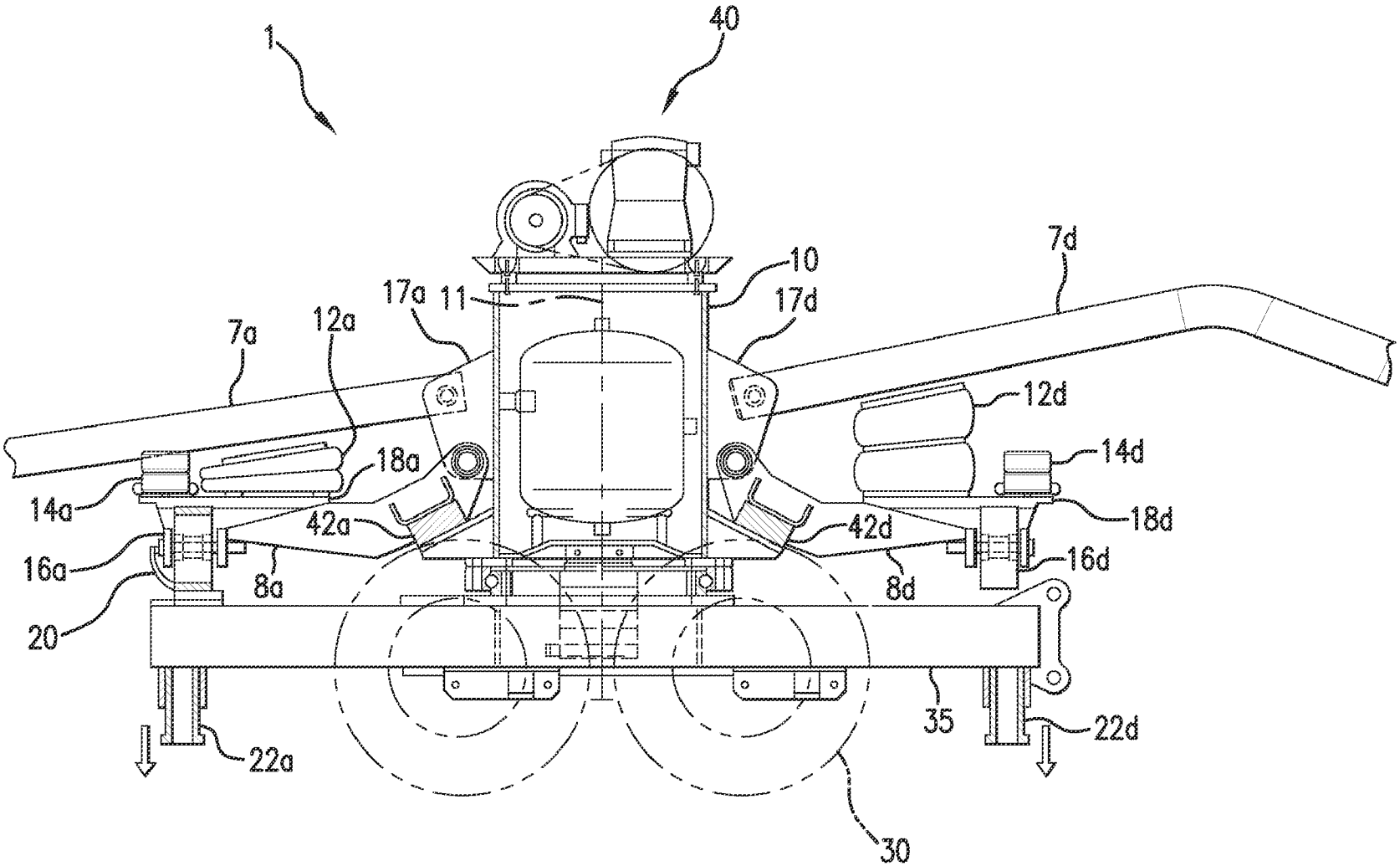
FIG. 4 is a more schematic cross-sectional view of the central unit of an example embodiment of an amusement ride according to the present invention.

FIG. 4 illustrates in greater detail an example embodiment of an amusement ride according to the present invention and particularly illustrates an example mechanism for generating the vertical oscillatory motion of the carriages. The central unit 10 is positioned on a platform 35 and is rotatably coupled thereto. The central unit 10 includes or is coupled to an energy source, e.g., an electrical power source, and also includes a motor mechanism 40 that enables the unit to rotate around its vertical central axis 11 with respect to the platform 35. The platform 35, which provides support for the ride, may be moved between locations by wheels 30. Once a desired location is selected, retractable legs, e.g., 22*a*, 22*d* positioned beneath the platform 35 are extended to fix the ride 1 in place upon the floor and to level the ride 1. Each carriage is pivotably coupled by a shaft e.g., 7*a*, 7*d* to a plate fixture 17*a*, 17*d* rigidly attached to the external surface of the central unit 10. In addition, radially extending lower arms 8*a*, 8*d* positioned below the shafts 7*a*, 7*d* are also pivotably coupled to the plate fixtures 17*a*, 17*d*. Rollers 16*a*, 16*d* are rotatably fixed to the distal ends of each lower arm 8*a*, 8*d*. Horizontal support plates 18*a*, 18*d* are positioned on top of the rollers 16*a*, 16*d* and are fixed to the top surfaces of the lower arms 8*a*, 8*d*. On top of each of the support plates 18*a*, 18*d*, a bumper 14*a*, 14*d* and a bellows 12*a*, 12*d* is fixedly positioned. The bellows 12*a*, 12*d* may also be fixedly attached to lower surfaces of the shafts 7*a*, 7*d* or may be arranged to abut or strike the lower surface of the shafts 7*a*, 7*d* during the oscillation movement. Each of the rollers 16*a*, 16*d* is configured to engage at least one arrangement for inducing a vertical motion 20 positioned along the circumference of the platform 35. Upon engagement with a roller, the arrangement 20 exerts an upward force on the roller e.g., 16*a* that is transmitted to the lower arm 8*a* and then to the shaft 7*a* by means of the bellows 12*a*. In the example embodiment depicted, the arrangement 20 is implemented as an upwardly sloping ramp. Additional bumper elements 42*a*, 42*d* may be provided for the lower arms 8*a*, 8*d*. Bellows 12*a*, 12*d* may be, e.g., hydraulic, pneumatic, etc., and may be selectively inflatable and deflatable for loading and unloading, for adjustment during riding by the operator or a rider, etc. A pump system, compressor system and/or an accumulator system may be provided to inflate and deflate the bellows 12*a*, 12*d*. During loading of passengers, the bellows 12*a*, 12*d* may be in a deflated condition, and, immediately before the ride begins, the bellows 12*a*, 12*d* may be inflated. Then, when the ride is completed, the bellows 12*a*, 12*d* may again be deflated for unloading and subsequent loading. Sensors, e.g., proximity sensors, magnetic sensors, switches, etc., may be provided to prohibit the carriages from stopping on the ramp when the ride cycle is coming to an end.

The operation of the amusement ride may be explained as follows with reference to the above-described structures. As the central unit 10 rotates, the assemblies coupled to the central unit revolve circumferentially, whereby the rollers 16*a*, 16*d* periodically come into contact with the ramp 20. During this contact, the rollers 16*a*, 16*d* are lifted. Initially, the upward movement of the rollers 16*a*, 16*d* is transmitted the lower arms 8*a*, 8*d*, which pivot upwardly. As the lower arms 8*a*, 8*b* pivot, they apply force to the bellows 12*a*, 12*d*, which begin to compress. Since the compression of the bellows 12*a*, 12*d* is gradual, the upward movement of the lower arms is temporarily transmitted to the shafts 7*a*, 7*b* which therefore acquire a degree of upward movement in sympathy with the movement of the rollers 16*a*, 16*d* over the ramp 20. When the rollers 16*a*, 16*d* reach the end of the ramp 20, which may end abruptly, the rollers 16*a*, 16*d* they fall off in a downwardly, causing the lower arms 8*a*, 8*b* to pivot downwardly in relation to the shafts 7*a*, 7*b*, which in turn causes the bellows to expand. After a certain time, the shafts 7*a*, 7*b* reach an upper limit position and begin a downward motion under the weight of the passengers in the carriages. As the shafts pivot downwardly in relation to the lower arms 8*a*, 8*b* (since the lower arms are not forced downwards by the weight of the passengers), they compress the bellows 12*a*, 12*d*, which damp the downward movement of the carriages. Along their downward trajectory, the shafts 7*a*, 7*d* eventually come into contact with bumpers 14*a*, 14*d* which may include an elastic material such as rubber that induce the shafts to rebound upwardly. Since the shafts 7*a*, 7*d* come into contact with the bumpers 14*a*, 14*d* while the lower arms 8*a*, 8*d* do not, the shafts 7*a*, 7*d* acquire an upward movement relative to the lower arms 8*a*, 8*d* which spreads the shafts 7*a*, 7*d* apart from the lower arms 8*a*, 8*d* and causes the bellows 12*a*, 12*b* to expand. This oscillation continues during the duration of the ride. The oscillation may be considered to be periodic in the sense that a ramp 20 provided at one or more locations imparts the oscillating movement periodically as each carriage 5*a*, etc., passes the ramp(s) 20. The ramp 20 may have an upwardly sloped portion in the direction of travel of the carriages 5*a*, etc., which may have a simple profile as a wedge or a more complex profile, e.g., undulating. The upwardly sloped portion may end abruptly or may end more gradually depending upon the desired performance of the ride.

In the foregoing manner, the differential pivoting of the shafts 7*a*, 7*d* with respect to the lower arms 8*a*, 8*d* (and vice versa) generates a cyclic expansion and compression of the bellows 12*a*, 12*d*. In sum, the periodic effect of the ramps, the weight of the carriages and the bumpers, together with the associated cyclic damping effect of the expansion and compression of the bellows, brings about a damped oscillatory motion of the carriages, which the passengers experience as a smooth and undulating 'jumping around' motion.

What is claimed is:

1. An amusement ride, comprising:

a central unit configured to rotate about a central axis;

a plurality of carriages positioned circumferentially around the central unit and pivotably coupled to the central unit by a respective cantilever arm, the carriages rotatable about the central axis in accordance with rotation of the central unit; and an arrangement configured to induce each carriage to periodically oscillate in a substantially vertical direction during rotation of the carriages about the central axis.

2. An amusement ride, comprising:

a central unit configured to rotate about a central axis;

a plurality of carriages positioned circumferentially around the central unit and pivotably coupled to the central unit by a respective cantilever arm, the carriages rotatable about the central axis in accordance with rotation of the central unit;

an arrangement configured to induce each carriage to periodically oscillate in a substantially vertical direction during rotation of the carriages about the central axis; and an arrangement configured to damp the periodic oscillation of the carriages.

3. An amusement ride, comprising:

a central unit configured to rotate about a central axis;

a plurality of carriages positioned circumferentially around the central unit and pivotably coupled to the central unit by a respective cantilever arm, the carriages rotatable about the central axis in accordance with rotation of the central unit; and an arrangement configured to induce each carriage to periodically oscillate in a substantially vertical direction during rotation of the carriages about the central axis;

wherein the amusement ride includes a plurality of cantilever arms, via which the carriages are pivotably coupled to the central unit, the amusement ride further comprising:

a plurality of lower arms pivotably coupled to the central unit, each lower arm arranged below a corresponding shaft; and a bellows arranged between each corresponding pair of cantilever arms and lower arms.

4. The amusement ride according to claim 3, wherein each of the bellows may be configured to at least one of (a) expand and (b) compress when the respective cantilever and lower arm to which it is coupled pivot relatively with respect to one another.

5. An amusement ride, comprising:

a central unit configured to rotate about a central axis;

a plurality of carriages positioned circumferentially around the central unit and pivotably coupled to the central unit by a respective cantilever arm, the carriages rotatable about the central axis in accordance with rotation of the central unit; and an arrangement configured to induce each carriage to periodically oscillate in a substantially vertical direction during rotation of the carriages about the central axis;

wherein the amusement ride includes a plurality of cantilever arms, via which the carriages are pivotably coupled to the central unit, the amusement ride further comprising:

a plurality of lower arms pivotably coupled to the central unit, each lower arm arranged below a corresponding shaft;

a bellows arranged between each corresponding pair of cantilever arms and lower arms; and a plurality of bumpers, each bumper positioned adjacent to and beneath a corresponding one of the bellows.

6. The amusement ride according to claim 5, wherein the bumpers are configured to stop a downward pivoting of a corresponding cantilever arm.

7. An amusement ride, comprising:

a central unit configured to rotate about a central axis;

a plurality of carriages positioned circumferentially around the central unit and pivotably coupled to the central unit by a respective cantilever arm, the carriages rotatable about the central axis in accordance with rotation of the central unit; and an arrangement configured to induce each carriage to periodically oscillate in a substantially vertical direction during rotation of the carriages about the central axis;

wherein the arrangement configured to induce the carriages to oscillate in a substantially vertical direction includes a ramp, the ramp including an abruptly ending upwardly sloping portion.

8. An amusement ride, comprising:

a central unit configured to rotate about a central axis;

a plurality of carriages positioned circumferentially around the central unit and pivotably coupled to the central unit by a respective cantilever arm, the carriages rotatable about the central axis in accordance with rotation of the central unit; and an arrangement configured to induce each carriage to periodically oscillate in a substantially vertical direction during rotation of the carriages about the central axis;

wherein the arrangement configured to induce the carriages to oscillate in a vertical direction includes a ramp, the ramp including an upwardly sloping portion that ends in a substantially vertical portion.

9. An amusement ride, comprising:

a central unit configured to rotate about a central axis;

a plurality of carriages positioned circumferentially around the central unit and pivotably coupled to the central unit by a respective cantilever arm, the carriages rotatable about the central axis in accordance with rotation of the central unit; and an arrangement configured to induce each carriage to periodically oscillate in a substantially vertical direction during rotation of the carriages about the central axis;

wherein the carriages are arranged in the shape of a motor vehicle.

10. An amusement ride, comprising:

a central unit for rotating about a central axis;

a plurality of carriages positioned circumferentially around the central unit and pivotably coupled to the central unit by respective pivoting means, the carriages rotatable about the central axis in accordance with rotation of the central unit; and means for inducing each carriage to periodically oscillate in a substantially vertical direction during rotation of the carriages about the central axis.

11. A method for operating an amusement ride having a plurality of carriages, comprising:

rotating the carriages on a central unit about a central axis;

moving the carriages upwardly during the rotating step at least one first predetermined circumferential position;

after the moving step and during the rotating step, abruptly dropping the carriages at a second predetermined circumferential position after the upwardly moving step; and after the dropping step and during the rotating step, resiliently oscillatingly bouncing the carriages.

12. The method according to claim 11, further comprising damping the oscillatory motion of the carriages.

13. The method according to claim 11, wherein the carriages are pivotably coupled to the central unit by cantilever arms, the cantilever arms arranged to interact with bellows to damp a pivoting motion of the cantilever arms.

14. The method according to claim 13, wherein the cantilever arms are coupled to rollers that periodically engage an upwardly sloping ramp during the rotating step.

15. The method according to claim 11, further comprising elastically stopping a downward movement of the carriages at a lower limit point.

* * * * *